United States Patent [19]

Williams

[11] 4,033,157

[45] July 5, 1977

[54] LOCKING MECHANISMS

[75] Inventor: John Williams, Georgetown, Canada

[73] Assignee: Canadian Business Machines Ltd., Mississauga, Canada

[22] Filed: Nov. 12, 1975

[21] Appl. No.: 631,219

[52] U.S. Cl. ..... 70/85; 70/337; 70/DIG. 20; 70/DIG. 63; 292/169.18; 312/218

[51] Int. Cl.[2] ..... E05B 65/46

[58] Field of Search ..... 70/85–88, 70/124, 129, 134, 150, 240, 241, 337, 339, DIG. 20, DIG. 63; 292/168, 169.18, 174, 179; 312/218

[56] References Cited

UNITED STATES PATENTS

| | | | |
|---|---|---|---|
| 1,574,712 | 2/1976 | Stone | 70/87 |
| 1,723,126 | 8/1929 | Best | 70/339 |
| 3,010,306 | 11/1961 | Toepfer | 70/337 |
| 3,082,617 | 3/1963 | Kerman | 292/179 X |
| 3,141,319 | 7/1964 | Schlage | 70/86 X |
| 3,401,998 | 9/1968 | Evans et al. | 312/218 X |
| 3,581,530 | 6/1971 | Raspadori | 70/339 X |
| 3,811,302 | 5/1974 | Sorensen | 70/129 X |

*Primary Examiner*—Roy D. Frazier
*Assistant Examiner*—William E. Lyddane
*Attorney, Agent, or Firm*—G. James M. Shearn

[57] ABSTRACT

The invention provides a locking mechanism to control the latch on a cabinet drawer or the like having a bolt which operates to engage or release the latch, the bolt in turn being controlled by a locking pin activated by a key operated cylinder lock. Additionally, the locking mechanism may have a second set of locking pin and cylinder lock over-riding and controlling access by the first cylinder lock.

3 Claims, 10 Drawing Figures

LOCKING MECHANISMS

This invention relates to locking and latching mechanisms. In particular, it relates to device suitable for locking file cabinets, counter drawers, teller drawers, cash drawers and the like.

In some embodiments the present invention provides a superior locking device with a high degree of security such as could be used in banks where it might, for instance, be desirable to have cash drawers accessable only when unlocked by two keys, one held by the Manager and one by the teller.

Locking devices for uses to which the present invention is most suitable, which is cash drawers etc., often require a high degree of sophistication, not only to make them difficult to circumvent or overcome but also to provide flexible control over access to the drawer, reliability of performance and a mechanism which is inaccessable to unauthorized persons, but which may be easily replaced or changed (thereby changing the keys which will permit access to the device) by authorized persons.

It is therefore, the purpose of the present invention to provide a locking mechanism which in combination with the latching mechanism will provide secure reliable control over access to drawers, file cabinets, and alike. It is further an object to this invention to provide a mechanism which may be easily, neatly and efficiently installed in such cabinets and counters.

It is a further object of this invention to provide a locking mechanism which may provide for access to a lockable drawer such that the access may be controlled by a control key and a users key so that the person in possession of the control key can set the mechanism so that it is either accessable to the person with the users key or not accessable.

These and other objects are sought to be obtained by a locking mechanism which is suitable for a cabinet drawer or the like of the type which has a latch engagable with said drawer to prevent its opening or disengagable to allow its opening. The locking mechanism is adapted to control the operation of the latch on the drawer by having a locking bolt which is movable axially to control the engagement or disengagement of the latch means. A cylinder lock is part of the locking mechanism and is operable (by a key) to control the axial movement of the bolt by an eccentric lug mounted on the cylinder lock which functions to move a locking pin into and out of engagement with a notch in the bolt so that the movement of the bolt (and its control over the latching means) may be locked or released. Further sophistication is provided by having a second combination of cylinder lock and locking pin so that one key holder may have an over-riding control over the access to the drawer by a subordinate key holder.

The invention can be better understood by the following description of one embodiment with reference to the accompanying drawings in which:

FIG. 1 is a cutaway perspective view of an installation of a locking and latching mechanism in accordance with the present invention in a typical cabinet;

FIG. 2A and 2B respectively are vertical cross sections the locking mechanisms shown in the locked and the unlocked positions respectively;

Figure 5A:
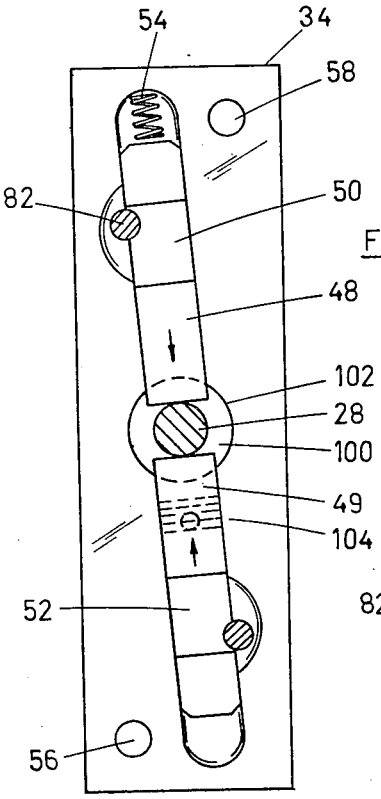
Figure 7:
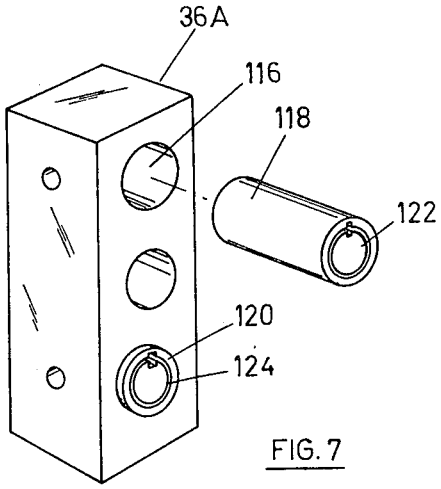
Figure 6:
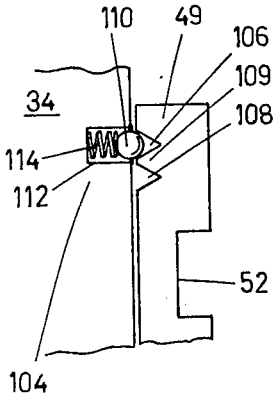

FIGS. 5A, B and C are vertical views of one portion of the locking mechanism showing the device in double-locked, single-locked and unlocked positions;

FIG. 6 is a cross-section view of the locking mechanism showing means for controlling the locking position of the locking device;

FIG. 7 illustrates use of the invention with an alternative type of cylinder lock.

Figure 1:
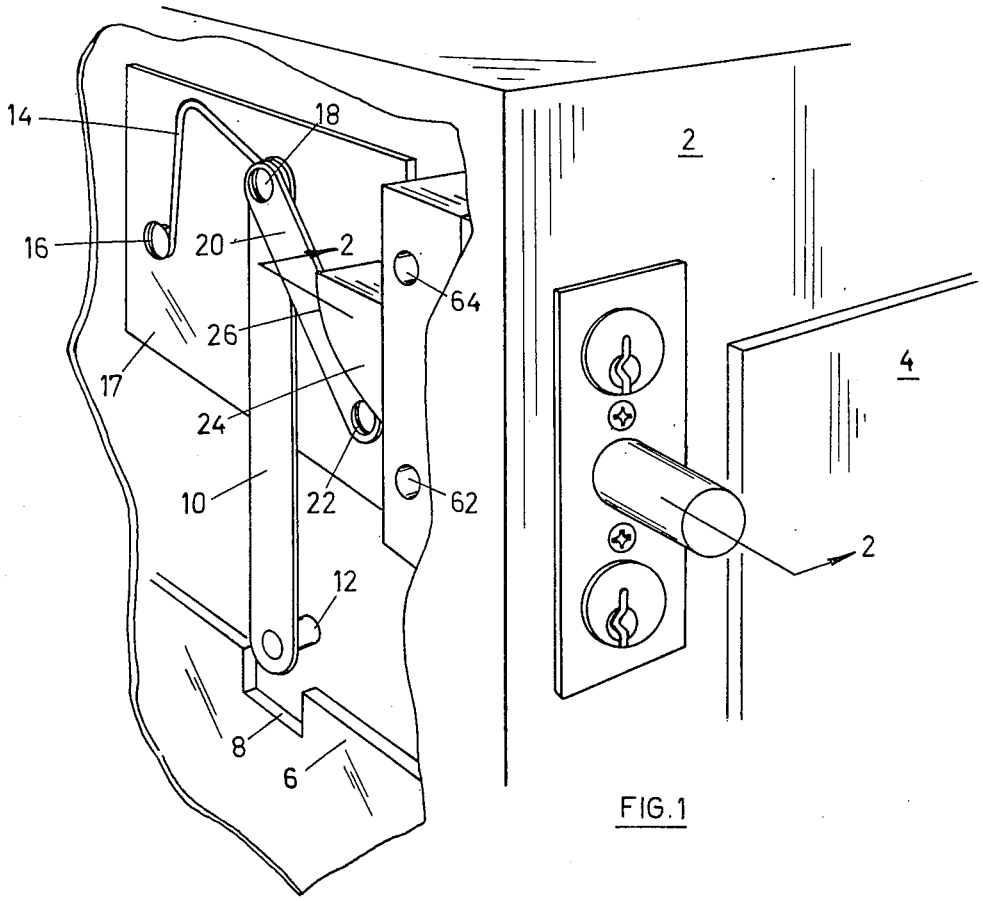

The perspective view of FIG. 1 illustrates a corner of a cabinet having a front wall, top and a side wall which is cut away for purposes of illustration. The cabinet has a drawer the front of which is illustrated at 4 and the side of which is shown through the cut away side wall at 6. It is this drawer which the locking mechanism illustrated is designed to control.

Whether or not the drawer can be opened depends on the location of the latch pin 12 relative to notch 8 in the side wall of the drawer. In the illustrated position the drawer may be opened but if the latch pin has moved vertically to the down position where it engages the notch 8 it will prevent the drawer from opening. The latch pin 12 is mounted on a latching arm 10 which extends vertically downward from the pivot point 18. Of course, in order to be effective it would be necessary to restrict the horizontal pivoting of the latch arm 10 and this can be done by means of a bracket (not shown) which could for instance be bolted or spot welded to the inner side of the cabinet so as to allow the arm 10 to move only in the vertical direction (except to allow sufficient play to accommodate the pivoting movement of the mechanism).

The latching arm 10 is pivotally mounted to the end of a pivot arm 20 which in turn is pivotally mounted near its other end at 22 to the mounting plate 17. A spring 14 is also mounted to the mounting plate at 16 and attached to the pivot point 18 and adapted to urge the pivot arm and latching arm in the upward direction. Although, for ease of illustration, the mounting plate is shown on the right hand side of the aforementioned arms in FIG. 1 it could be on the opposite side where it would be adjacent to the side wall of the cabinet to which it could be easily attached in the installation of the mechanism.

The aforementioned parts which latch or unlatch the drawer may be hereinafter referred to generally as the latching mechanism and are controlled as to their position by the urging of the cam 24 which is shaped and positioned to engage the top edge of the pivot arm 20 and is capable of urging the arms downward against the resistance of the spring 14 to engage the latch pin 12 in the notch 8 thereby locking the drawer.

Figure 2A:
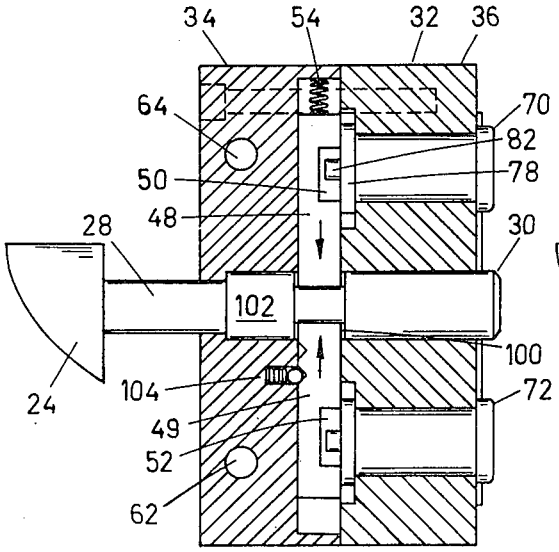
Figure 2B:
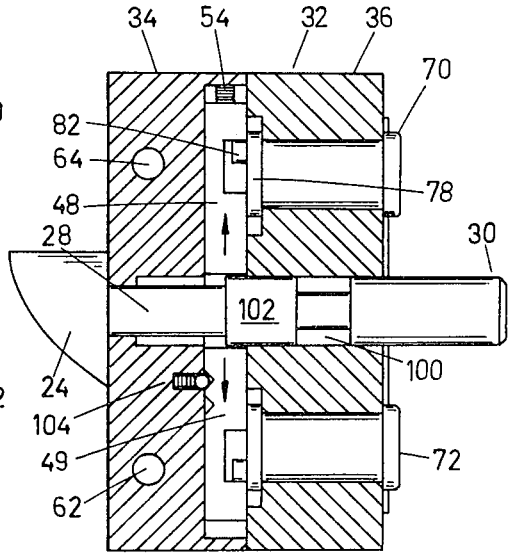

The curved face 26 of the cam 24 may be activated to urge the latching mechanism downwards by advancing the shaft 28 by pressing the locking bolt 30 as can be seen in FIGS. 2A and 2B. The locking bolt 30 and its shaft 28 are movable axially, back and forth along a bore in two sections 32 and 34 which constitute the housing of the locking mechanism. When the bolt 30 is pressed in as shown in FIG. 2A the cam will engage the latch to keep the drawer locked. When the bolt is in the out position as shown in FIG. 2B the latching mechanism will be released.

The aforementioned spring 14 in addition to urging the latching arms upwards will also in consequence tend to urge the locking bolt to the out position unless otherwise depressed or held in. The locking or the unlocking of the locking mechanism is controlled by two cylinder locks 70 and 72 respectively. These may be conventional cylinder locks of the type which use tumbler pins (as seen in FIG. 3) and are operated by a conventional type of key.

Figures 3, 4:
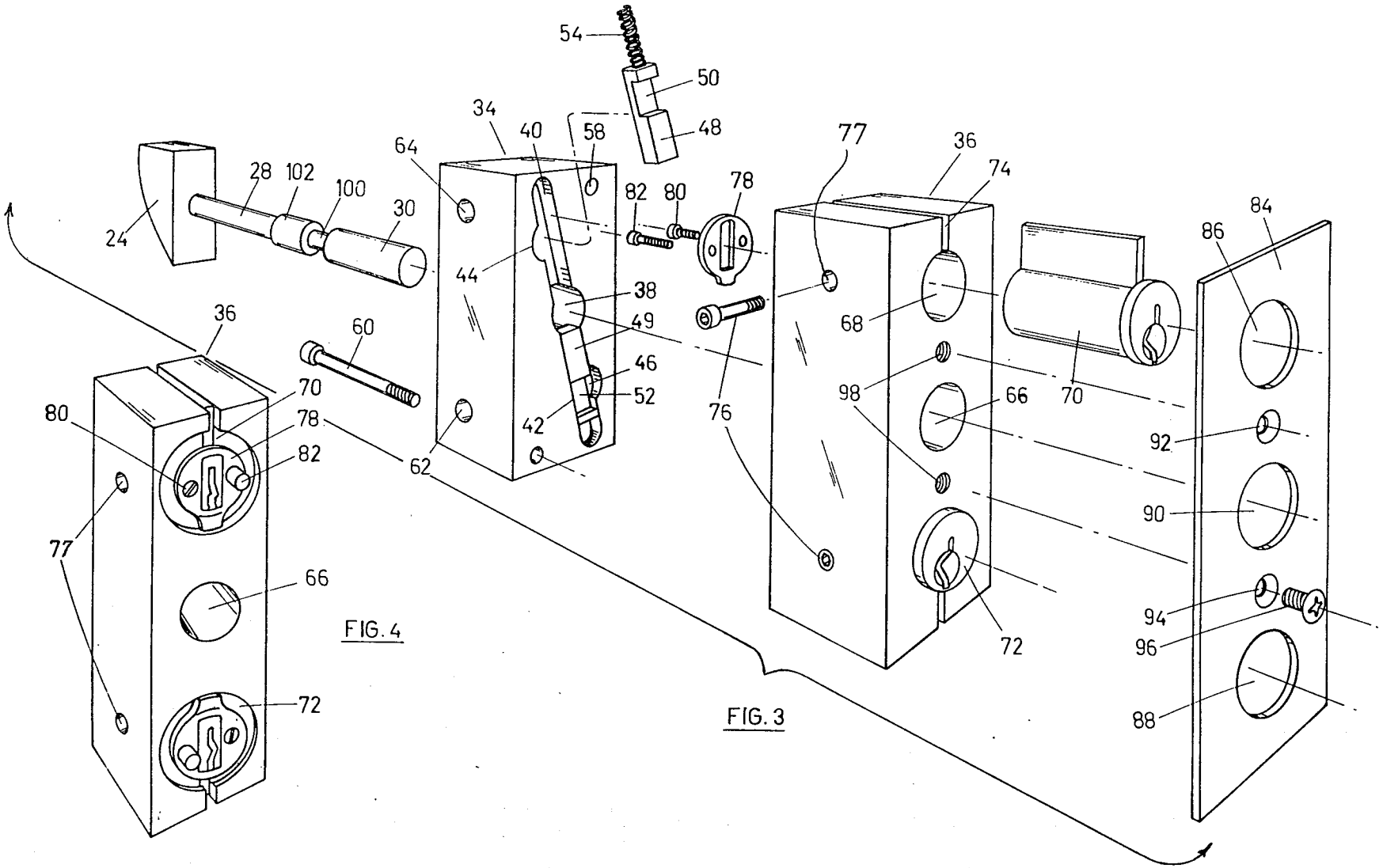
FIG. 3 is an exploded perspective view of the components of the locking mechanisms.
FIG. 4 is a perspective view showing the rearward face of one portion of the locking mechanism.

The correct key inserted in the cylinder locks and turned will rotate the plate 78 attached by means of the screw 80 to the back of the cylinder lock as illustrated in FIG. 4. The rotating of this plate will move the eccentric pin 82 which is off-centre and protruding rearwards from the plate 78 and in the assembled mechanism extends into the notch 50 or 52 of the locking pins 48 or 49 respectively.

These locking pins rest within slots 40 and 42 (which have an open end communicating with the path of travel 38 of the bolt as best seen in FIG. 3) and are capable of sliding up and down within those slots.

Upper locking pin 48 is controlled by a spring 54 compressed between it and the top of the slot 40 which tends to urge the locking pin downward into the annular recess 100 in the bolt 30 if the bolt is in the position shown in the FIG. 2A. In this position the locking pin will present the outward movement of the bolt and prevent the release of the latching mechanism. However, a key turned in the cylinder lock 70 will move the eccentric pin 82 to the upper position shown in FIG. 2B where it engages the top of the notch 50 of the locking pin and urges it upwards out of the recess 100 of the locking bolt.

The lower locking pin 49 may also be moved out of the engagement with the locking bolt (as shown in FIG. 2B) by a corresponding eccentric pin on the back of the cylinder lock 72 which engages the top of the notch 52. However, in the embodiment shown the lower locking pin is not urged into the locking position of FIG. 2A by a spring. Rather, it is designed to rest in either the locked or unlocked position by means of a positioning mechanism 104 which is best illustrated in FIG. 6, where it can be seen that a ball 110 is set in the base of the slot 42 where under the urging of the spring 114 in the recess 112 it is caused to protrude slightly into the slot against the underside of the locking pin 49 which has two parallel grooves 106 and 108 defining a ridge 109 between them. This ball positioning device will hold the locking pin either in the locked or unlocked position wherever the operator leaves it. FIG. 6 for instance, is in the unlocked position and will remain in unless a key is inserted in the cylinder lock 72 and turned to urge the locking pin 49 under the influence of the eccentric pin upwards into the locking position so that the ball rests in the groove 108 in which position it will remain until the operator changes it.

Figure 5B:
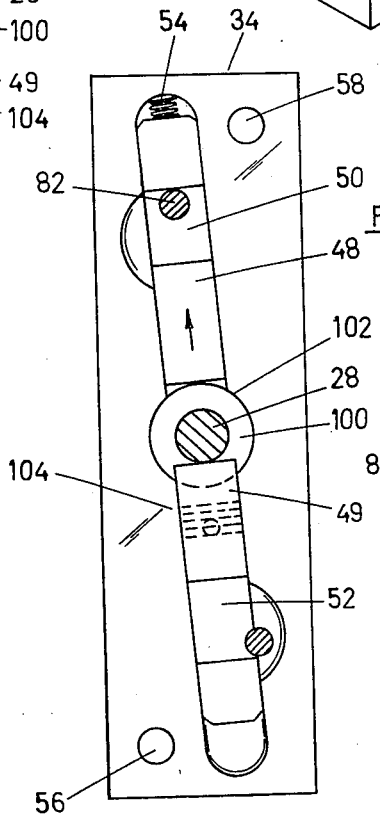
Figure 5C:
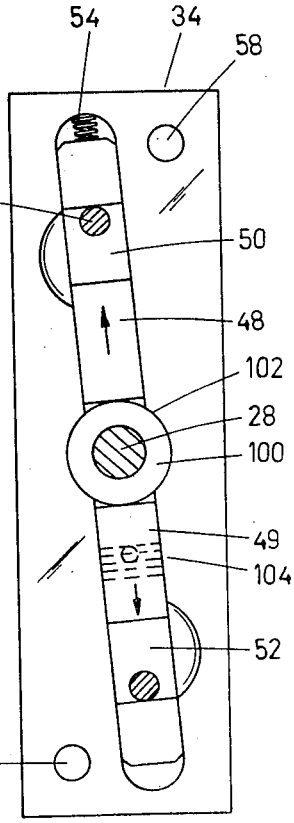

The relative position of the eccentric pins and the notches of the locking pins 48 and 49 is best illustrated by the sequence of drawings in FIG. 5A, 5B and 5C. When viewed in conjunction with FIGS. 2A and 2B it will be seen that this locking mechanism may be in one of three modes; double locked, single locked or unlocked. For purposes of illustrating the operation of this embodiment it may be imagined that the lock is designed to operate a cash drawer of a teller's cage and the bank manager possesses the key to the control lock 72 while the teller possesses the key to the users lock 70. Thus during the night and at the beginning of the day the drawer may be double-locked in the mode illustrated in FIG. 2A and 5A. In this position neither the manager or the teller may have access alone to the drawer. However, the Manager may be operating lock 72 disengage the locking pin 49 from the recess 100 of the shaft 30 as he might do at the beginning of the day's business or he might subsequently, during the day if he wishes to secure the drawer relock the mechanism by pushing in the bolt 30 and engaging the locking pin 49.

During the business day however, the control lock may remain in the unlocked position and the individual teller may lock or unlock the drawer from time to time as desired. FIG. 5B illustrates the semi-locked position in which the users key has been used to disengage the locking pin 48 but the control lock has not released the locking pin 49 and prevents access to the holder of the user's key. Alternatively, and more common, the control lock may be disengaged while the user's lock is engaged. FIG. 5C corresponding to FIG. 2B illustrates the position when both locks are unlocked in which case the spring 14 would urge the bolt 30 outwards and release the drawer.

FIG. 3 illustrates features of the assembly of the locking mechanism. The section housing the locking pin (34) and the section housing the cylinder lock (32) abut face to face and are secured together by bolts such as 60 which extend through housing section 34 to engage housing section 32 in the lower left and upper right corners.

Set screws are threadably engaged into threaded holes in the housing section 32 to secure the cylinder locks 70 and 72 into their respective bored holes 68 such as illustrated at 76 and 77 respectively. Vertical slots such as 74 extend from the cylinder lock bores to allow room for the tumbler pins which protrude from the cylinder lock if that type of cylinder lock is used. FIG. 7 illustrates an alternative arrangement in which the housing section 36A has no corresponding slots and the bore 116 is intended to receive cylinder lock 118 which is designed to be operated by a cylindrical key inserted at 122. This type of lock has pins which are activated in directions parallel to the axis of the lock and requires no slot such as 74. However, the arrangement shown in FIG. 3 is to be preferred since it will house either type of cylinder lock.

The term cylinder lock herein is used for convenience in contemplating a lock which is operated by inserting and rotating a key but the invention is not limited to a narrow definition of the term "cylinder lock".

The holes 62 and 64 bored from side to side through the housing section 34 illustrate means for mounting the locking mechanism to the side of the cabinet. For instance there might be a threaded bolt or plate on the inside of the side wall of the cabinet to which bolts extending through holes 62 and 64 would attach.

The threaded holes 98 in the face of the housing 36 are designed to receive screws such as 96 through the holes 92 and 94 of a face plate 84. This face plate which has holes 86 and 88 to expose the face of the cylinder locks and hole 90 to allow protrusion of the locking bolt 30 would serve to cover any enlarged or unsightly opening in the face of the cabinet.

Although the set screws are illustrated in FIG. 3 from the left side they may be inserted through the holes 76 shown in FIG. 4 on the right side which would allow authorized persons to reach inside the drawer and release the cylinder locks 70 and 72 so that they can be changed whenever desired if, for instance, a key was lost. A new lock and new set of keys could re-establish security without the necessity of removing the entire locking or latching mechanism.

Because the control key apparatus is not spring loaded it will remain in the locked or unlocked position as the operator sets it. However, the locking pin 48 connected to the users lock is spring loaded and therefore any time the teller (for instance) wants to lock the drawer for a short period of time while absent it is only necessary to depress the bolt 30 to the in position where it engages the latch mechanism and the spring 54 will engage the locking pin 48 in the locked position until the users key is used to release it and release the locking bolt. Once released the enlarged portion 102 of the locking bolt will maintain the locking pin 48 in the up position until the locking bolt is depressed again.

Thus, access to the drawer may be controlled in two ways; by a control key which can over-ride the reset of the mechanism and maintain the drawer locked or can release the mechanism to be locked or unlocked intermittently by the teller or someone else who has a users key which will operate the other cylinder lock.

Such a control arrangement is merely illustrative. Other combinations of access control might be devised and various modifications and variations from the structural embodiment illustrated might be employed without departing from the inventive concept herein.

What I claim as new and desire to protect by Letters Patent of the United States is:

1. A locking mechanism for locking the drawer of a cabinet or the like, of the type having latch means engagable with said drawer to prevent its opening and disengagable to allow its opening; said locking means comprising:

a housing adapted to be mounted on said cabinet and adjacent said drawer;

a bolt bore hole extending through said housing perpendicular to the front of said cabinet;

a locking bolt movable axially within said bolt bore hole and having a circumferential recess therein;

a pair of slots in said housing extending from opposite sides of said bolt bore hole normal to the axis thereof;

a locking pin in each of said slots, each said pin having a forwardly open notch therein, and being movable along said slots into and out of a position of projection into said bolt bore hole and into said circumferential recess;

a pair of cylinder lock bore holes spaced from said bolt bore hole in the directions corresponding to said slots and extending parallel to said bolt bore hole to connect with said slots;

a cylinder lock in each of said cylinder lock bore holes having on the end thereof lugs projecting into said slots to engage said notches in said pins and operable in response to a key turned in said cylinder locks to move said pins in and out of said bolt bore hole;

one of said pins being urged towards said bolt by compression spring means mounted in its associated slot, and being movable away from said bolt against said spring means by operation of its respective cylinder lock;

the other of said pins being positionable to remain in an unlocked position removed from said bolt bore hole and a locked position projecting into said bolt bore hole in response to operation of its respective cylinder lock;

cam means on said bolt adapted to operate said latching means to engage or disengage same in response to axial movement of said bolt;

said recess of said bolt being positioned opposite said slots and adapted to receive said pins when said bolt is in the locking position.

2. A locking mechanism as claimed in claim 1 in which said other pin is positionable by means of a resiliently depressable protrusion in the wall of said slot engagable with a pair of further notches in said pin, one of said further notches corresponding to the unlocked position, the other corresponding to the locked position of said pin.

3. A locking mechanism as claimed in claim 2 in which said housing comprises a first section and a second section abutting each other at opposite faces and said slots are formed in one of said faces.

* * * * *